US005262602A

United States Patent [19]

Mattson

[11] Patent Number: 5,262,602

[45] Date of Patent: Nov. 16, 1993

[54] HIGH CURRENT AND LOW CURRENT SWITCH

[75] Inventor: Lynton G. Mattson, Isanti, Minn.

[73] Assignee: FMC Corporation, Chicago, Ill.

[21] Appl. No.: 930,877

[22] Filed: Aug. 14, 1992

[51] Int. Cl.[5] ..... H01H 15/00

[52] U.S. Cl. ..... 200/52 R; 200/16 E

[58] Field of Search ..... 200/16 B, 16 E, 52 R, 200/61.53, 51.09, 51.1

[56] References Cited

U.S. PATENT DOCUMENTS 3,739,109 6/1973 Ege ..... 200/4

4,737,603 4/1988 Lycan ..... 200/18

*Primary Examiner*—A. D. Pellinen

*Assistant Examiner*—Michael A. Friedhofer

*Attorney, Agent, or Firm*—Michael Lee; R. C. Kamp; R. B. Megley

[57] ABSTRACT

The invention provides an electrical switch which reduces arcing by utilizing slidably mating members. In addition the switch provides large area gold contacts. Because of the above characteristics the invention provides a switch that can handle high and low current and allows dry current switching. In addition the inventive switch provides a switch which closes an alternative circuit to indicate that the normal circuit is open.

14 Claims, 2 Drawing Sheets

HIGH CURRENT AND LOW CURRENT SWITCH

In switches for various applications there is a need for certain switches which are able to pass both high currents and low currents and to provide switching when no current or voltage is present (dry current). There may also be a need for a fail safe on such switches. One example of a need for such a switch is a fail safe switch for a missile system. In such a switch, it is desirable for the switch to at one time handle a high current which is used to activate a missile squib, such as used in an explosive bolt or rocket motor, and at another time handle a low current which is used to test the squib electrical circuit without activating the squib. It would also be desirable to provide a switch with a fail safe, which operates in complement of the normal switch such that the open condition of the switch can be monitored and indicated by a closed contact.

Figure 1:
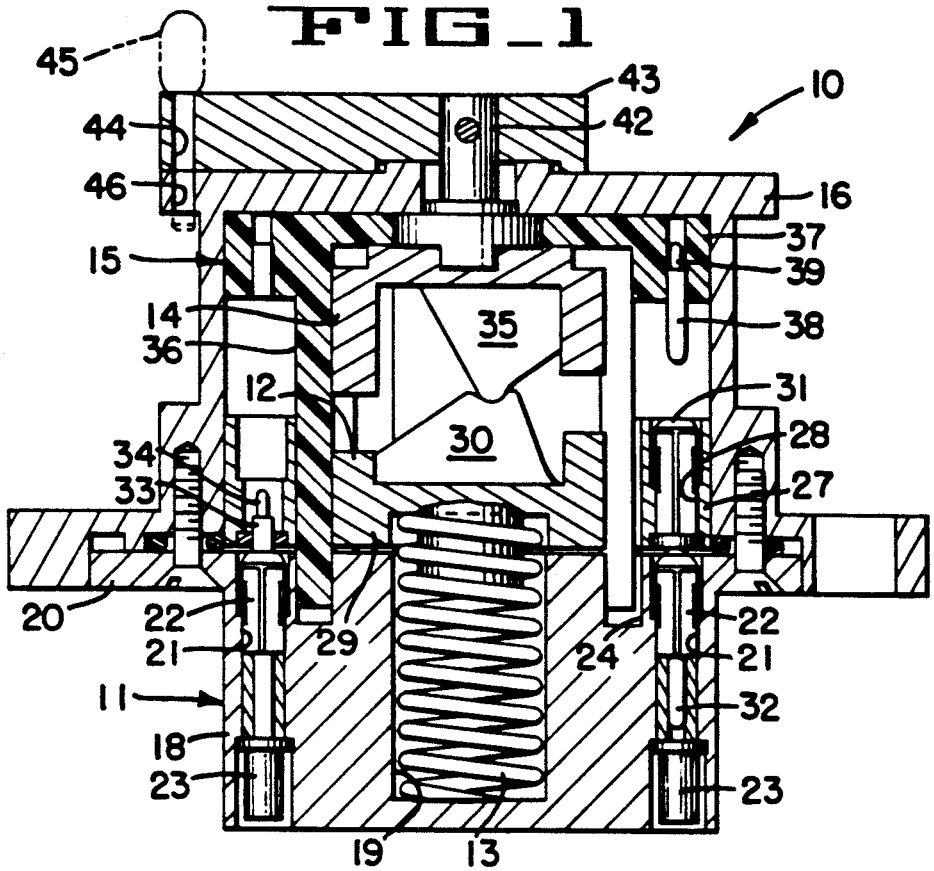
FIG. 1 is a cross sectional view of a preferred embodiment of an electrical switch in an open position.

FIG. 1 illustrates a switch 10 comprising a contact block 11, an armature 12 adjacent to the topside of the contact block 11, a spring 13, a cam piece 14 adjacent to the topside of the armature 12, a jumper pin block 15 adjacent to the topside of the cam piece 14, a top housing 16 adjacent to the topside of the jumper pin block 15, and a plurality of electrical contacts more specifically described below. The contact block 11 has a cylindrical body 18 with a central recess 19, which opens to the top side of the cylindrical body 18 and which surrounds a first end of the spring 13. A circular flange 20 surrounds the topside of the cylindrical body 18. The cylindrical body 18 has a central axis, which is substantially parallel to a central axis of the spring 13. A plurality of holes 21 which are substantially parallel to the central axis of the cylindrical body 18, pass through the cylindrical body 18 and provides a surface for mounting the switch body. Within each of the plurality of holes 21 is a female electrical connector 22 and an electrical wire 23 connected, via crimp or solder to the female electrical connector 22. There are twelve pairs of female electrical connectors 22 with each pair of female electrical connectors comprising a first female electrical connector and a corresponding second female electrical connector. The switch 10 provides switching for twelve circuits, where each circuit has a first lead wire electrically connected to a first female electrical connector and a second lead wire electrically connected to the corresponding second female electrical connector. The contact block 11 also has a circular groove 24 that acts as a guide that aligns the jumper pin block 15 with the contact block 11.

The armature 12 has an outer ring 27 with a plurality of holes 28 in the outer ring 27 that match the plurality of holes 21 in the cylindrical body 18 of the contact block 11. Eleven pairs of the holes are filled with a eleven pairs female electrical connectors 31 with each pair of female electrical connectors comprising a first female electrical connector and a corresponding second female electrical connector. Pairs of electrical connector rods 32 with first ends and second ends extend from pairs of the female electrical connectors 31, wherein each pair of electrical connector rods 32 comprise a first connector rod with a first end and a second end and a corresponding second connector rod with a first end and a second end. For each pair of connector rods 32, the first connector rod 32 would have a first end mechanically connected to a first female connector 31 and a second end inserted into a first female connector 22 of the contact block 11 and the corresponding second connector rod 32 would have a first end mechanically connected to the second corresponding female connector 31 and a second end inserted into the second corresponding female connector 22 of the contact block 11. In this preferred embodiment, the mechanical connection between the female connectors 31 of the armature 12 and the electrical connector rods 32 is established by making them a single piece. In other embodiments they may be soldered or crimped together. In the assembled switch the armature 12 can only move a set maximum distance from the contact block 11. The connector rods 32 are of a sufficient length so that they will remain inserted in the female electrical connectors 22 of the contact block 11 when the armature 12 is within the set maximum distance from the contact block 11. One pair of holes are filled with male connectors 33 extending from the bottom side of the holes. An electrical conductor 34 electrically connects the top side of the male connectors 33. The outer ring 27 has a bottom side which faces the contact block 11 and a top side which faces away from the contact block 11. On the inside part of the armature 12 is an inner disk 29. The bottom side of the inner disk 29 is machined to receive a second end of the spring 13. The top side of the inner disk 29 has a follower shape 30 around the circumference of the inner disk 29.

The cam piece 14 is a disk shape with a diameter approximately equal to the diameter of the inner disk 29. On the bottom side and around the circumference of the disk shape are cam shapes 35, which mate with the follower shape 30 on the top side of the inner disk 29.

The jumper pin block 15 has a cylindrical body 36 with a central recess, which surrounds the cam piece 14 and the inner disk 29 of the armature 12 and is guided into the circular groove 24 of the contact block 11. A circular flange 37 is located on the top side of the cylindrical body 36. From the bottom side of the circular flange 37 extends 11 pairs of electrical male connectors 38. Eleven electrical conductors 39 electrically connects the top sides of each pair of electrical male connectors 38. Each pair of electrical male connectors 38 and the electrical conductors there between 39 in this embodiment form a single integrated jumper pin.

The top housing 16 has a top disk located adjacent to the top side of the jumper pin block 15, and a cylindrical flange that surrounds the jumper pin block 15 and attaches to the contact block 11.

A control shaft 42 passes through the top disk of the top housing 16 and has a first end which is mechanically connected to the cam piece 14. A control lever 43 is mechanically connected to a second end of the control shaft 42. An aperture 44 passes through the control lever 43. An aperture 46 is also present in the top housing 16.

Figure 3:
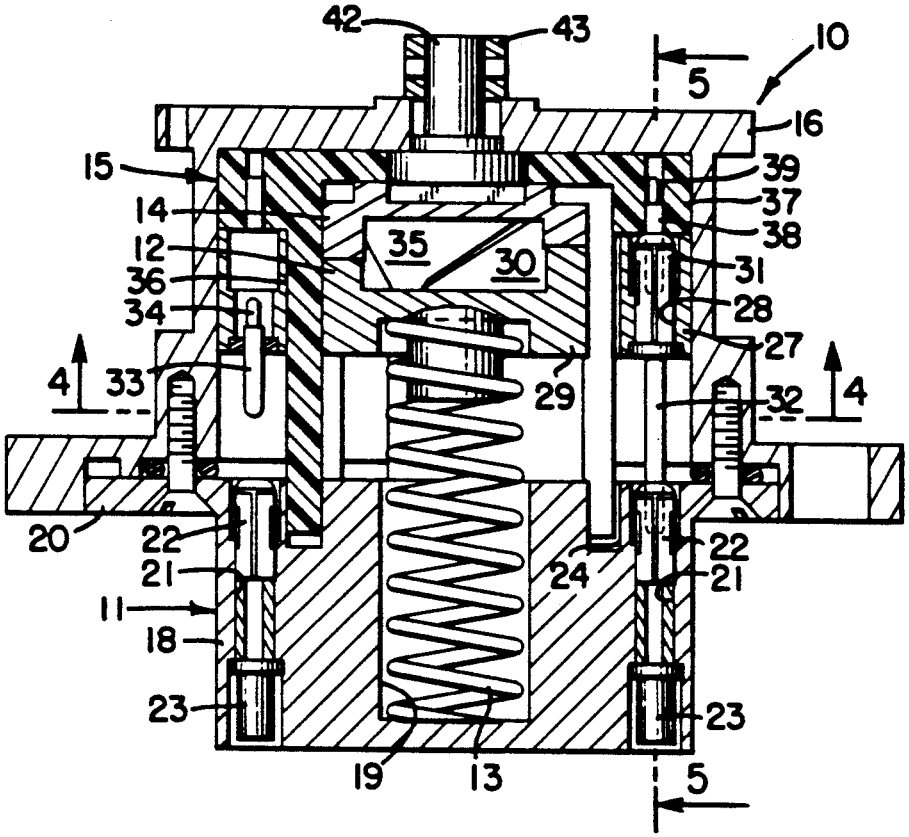
FIG. 3 is a cross sectional view of a preferred embodiment of an electrical switch in an closed position.
Figure 4:
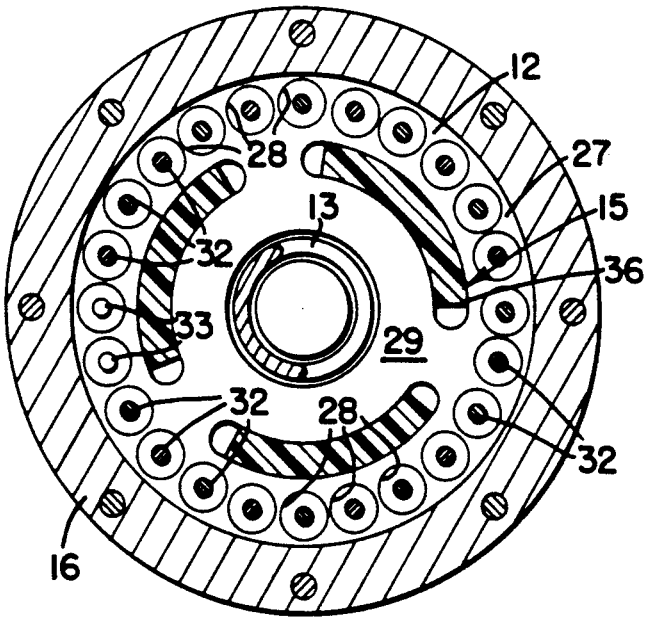
FIG. 4 is a horizontal cross section taken along lines 4—4 of FIG. 3.

FIG. 4 is a horizontal cross section taken along lines 4—4 of FIG. 3, which shows a cross sectional view of the armature 12 and parts of the jumper pin block 15 and the top housing 16. Part of the top housing 16 surrounds the armature 12. Twenty-four apertures 28 pass through the outer ring 27 of the armature 12. Twenty-two of the apertures 28 have electrical connector rods 32, while two have male connectors 33. The inner disk 29 of the armature 12 has a recess for the spring 13. Between the outer ring 27 and the inner disk 29 are apertures, through which the cylindrical body 36 of the jumper pin block 15 passes. This helps to maintain the alignment between the jumper pin block 15 and the armature 12.

Figure 5:
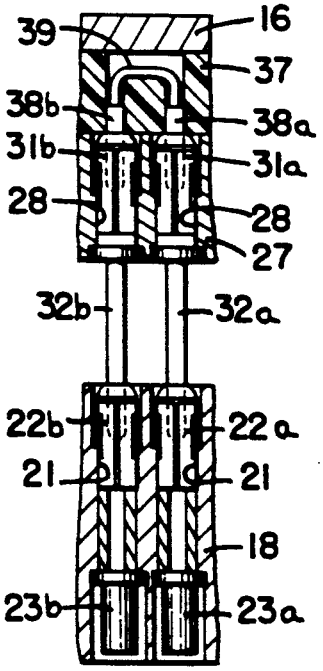
FIG. 5 is a vertical cross section taken along lines 5—5 of FIG. 3.

FIG. 5 is a vertical cross section taken along lines 5—5 of FIG. 3 and illustrates more clearly how a normal circuit is switched. With a first wire 23*a* lead of a circuit crimped or soldered into a first female connector 22*a* of a pair of female connectors 22 of the contact block 11, a first electrical connector rod 32*a* of a pair of electrical connector rods is engaged with the first female connector 22*a*. The first electrical connector rod 32*a* is made as a single piece with a first female connector 31*a* of a pair of female connectors of the armature 12. Engaged to the first female connector 31*a* is a first electrical male connector 38*a* of a pair of electrical male connectors of the jumper pin block 15. In this embodiment a jumper pin forms the first electrical male connector 38*a*, the second electrical male connector 38*b*, and the electrical conductor 39 between the first electrical male connector 38*a* and the second electrical male connector 38*b*. The second electrical male connector 38*b* is engaged in the corresponding second female connector 31*b* of the pair of female connectors of the armature 12. The corresponding second female connector 31*b* of the pair of female connectors of the armature 12 is made as a single piece with the second electrical connector rod 32*b* of a pair of electrical connector rods. The second electrical connector rod 32*b* of a pair of electrical connector rods is engaged in a second female connector 22*b* of a pair of female connectors 22 of the contact block 11, which is crimped or soldered to a second wire 23*b* lead to the circuit. In the closed position as illustrated in FIG. 5, a circuit goes from the first wire 23*a* lead through the first female contact 22*a* in the contact block 11, and through the first connector rod 32*a* to the first female connector 31*a* in the armature 12. From the first female contact 31*a* in the armature 12 the circuit goes to through the first electrical male connector 38*a*, and through the electrical conductor 39 to the second electrical male connector 38*b*. From the second electrical male connector 38*b*, the circuit goes through the second female connector 31*b* in the armature 12, through the second connector rod 32*b*, and through the second female connector 22*b* in the contact block 11 to the second wire 23*b* lead.

In an operative system using the above embodiment, twelve circuits connected to the switch where each circuit has a first lead wire and a corresponding second lead wire. For each circuit a first lead wire is crimped or soldered into a first female connector 22 of the contact block 11 and the corresponding second lead wire is crimped or soldered into the second corresponding female connector 22 of the contact block 11. When the control lever 43 is placed in a first position, the control shaft 42 has rotated the cam piece 14 to a first position as shown in FIG. 1. In this position the switch is in an open position, where the eleven (normal) circuits are open and the one (alternate) circuit is closed. In this position, the tip of the cam shapes 35 are pressed against a detent in the form of dips in the tips of the follower shape 30. This presses the armature 12 against the contact block 11. This causes the single pair of male connectors 33 mounted on the armature 12 to be inserted into their mating female electrical connectors 22 mounted in the contact block 11. The single circuit with lead wires electrically connected to the female electrical connectors mated to the pair of male connectors 33 is closed. For the remaining circuits, in this position, the male connectors 38 of the jumper pin block 15 are disengaged from the electrical female connectors 31 of the armature, causing the remaining circuits to be open. In this position the aperture 44 in the control lever 43 matches the aperture 46 in the top housing 16, so that a retaining pin 45 may be inserted through the apertures to lock the control lever 43 in the open position.

Figure 2:
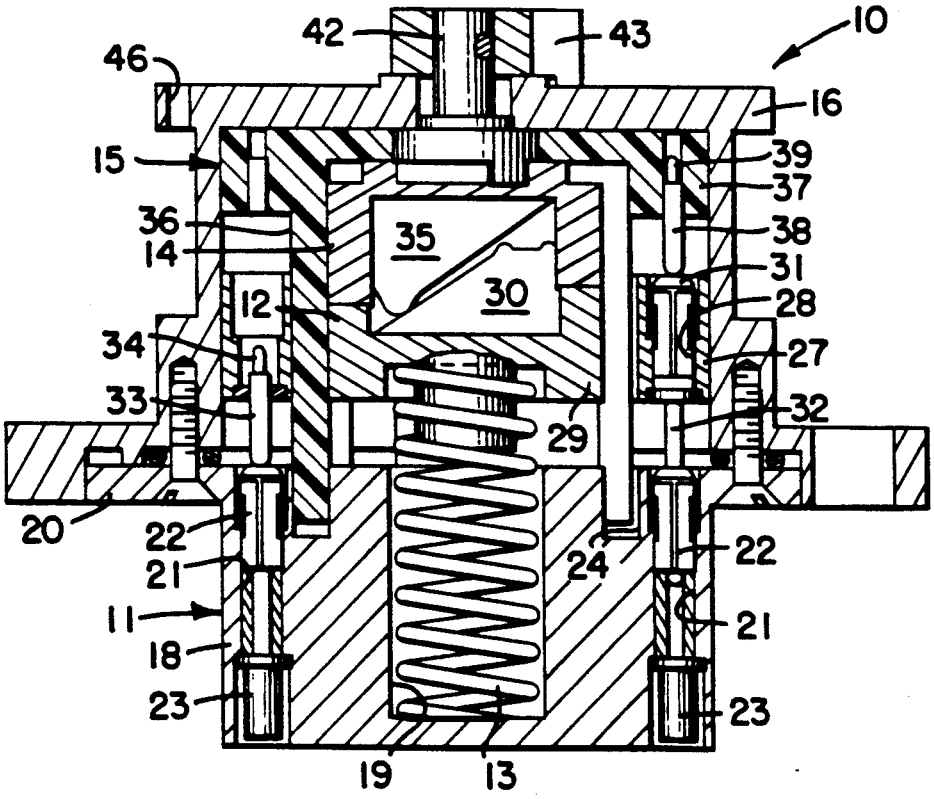
FIG. 2 is a cross sectional view of a preferred embodiment of an electrical switch in an mid travel position.

FIG. 2 illustrates the switch 10 in a mid travel position. The retaining pin 45 has been removed from the apertures 44, 46 to unlock the control lever 43. From the switch in FIG. 1 the control lever 43 is moved causing the control shaft 42 to rotate which causes the cam piece 14 to rotate. The tips of the cam shapes 35 move away from the tips of the follower shape 30, so that the spring 13 can force the armature 12 away from the contact block 11 towards the cam piece 14 and jumper pin block 15. Since the armature 12 is moving away from the contact block 11, the male connectors 33 on the armature 12 are removed from the female electrical connectors 22 to which they were mated. At the point shown in FIG. 2 the male connectors 33 on the armature 12 are completely removed from the female electrical connectors 22 causing the corresponding circuit to be opened. The female electrical connectors 31 on the armature 12 are moved toward the electrical male connectors 38 on the jumper pin block 15, but at the point shown in FIG. 2, the electric male connectors 38 on the jumper pin block are still disengaged from the female electrical connectors 31 on the armature 12, so that the corresponding eleven circuits are open.

FIG. 3 illustrates the switch 10 in a fully closed position. From the switch 10 illustrated in FIG. 1 the control lever 43 has been moved to cause the control shaft 42 to rotate 90°. This causes the cam shapes 35 to mate with the follower shape 30 so that the armature 12 has traveled a specified maximum distance from the contact block 11. The tip of the cam shapes 35 in some embodiments may be in detents formed by the follower shape 30. The electrical male connectors 38 of the jumper pin block 15 are inserted into matching female electrical connectors 31 of the armature 12, causing the corresponding eleven circuits to be closed. As in FIG. 2 the male connectors on the armature are disengaged from their corresponding female electrical connectors 22, so that the corresponding circuit is open.

Since the electrical connector rods 32 slide in the female connectors 22 of the contact block as the armature 12 moves up and down, arcing at the contacts is reduced. In addition, sliding of the male connectors in the female connectors also reduces arcing. Because of the mechanical design of the preferred embodiment, the preferred embodiment is able to use higher resistant gold contacts. The high resistant gold contacts may be used, because the invention provides large contact areas to compensate for expected contact resistance and self heating, which for small contact areas would destroy low current switching. In addition the above described sliding further decreases resistance. For this reason, the invention can handle currents from 0.005 amps to 10 amps, even when switched when no current is present (dry switching).

The preferred embodiment may further comprise various substitute parts which would perform in a manner contemplated by the present invention. For example, the contact block 11, which is fixed relative to the top housing 16, may be made to move either to matingly engage the male connectors 33 or to disengage it therefrom. Similarly, the spring 13 may be replaced by cranks and links, gears, chains, magnets or similar loading mechanisms. Further, the cam piece 14 may be replaced by a mechanical actuator or a similar device to orientably align the mating electrical connectors (22, 31 and 33). The cylindrical body may be varied to accommodate a typical application. In some applications, for example, rectangular and square shapes may be appropriate. For this reason insertion of a male connector into a female connector can be more generally defined as electrically connecting or electrical engagement and the removal of a male connector from a female connector may be more generally defined as electrically disconnecting.

In the previously described embodiment, a top side and bottom side was designated for a clearer explanation. Since the switch can be oriented in any direction, in the claims what was illustrated as the bottom side of an object in the embodiment will be designated as the first side of the object, and what was illustrated as the top of an object will be designated as the second side of the object.

While a particular embodiment of the invention has been shown and described, it will be obvious to those skilled in the art that changes and modifications can be made therein without departing from the invention in its broader aspects and, therefore, the aim in the appended claims is to cover all such changes and modifications as fall within the true spirit and scope of the invention.

What is claimed is:

1. A switch for opening and closing a first plurality of circuits, wherein each circuit has a first electrical lead and a corresponding second electrical lead, comprising:

a contact block with a first side and second side, comprising a plurality of pairs of female connectors, wherein each pair of female connectors has a first female connector and a corresponding second female connector and wherein each first electrical lead is electrically connected to a first female connector and each corresponding second electrical lead is electrically connected to a corresponding second female connector;

an armature, comprising a body with a first side and a second side and with a plurality of female connectors and a plurality of rods extending from the first side of the armature wherein each rod has a first end and second end wherein the first end is electrically connected to a female connector in the armature and the second end of the rod is inserted in a female connector of the contact block when the first side of the armature is placed within a minimum distance from the second side of the contact block, wherein the rods have a length such that the part of each rod will remain in a female connector of the contact block when the armature is moved between a minimum distance and a maximum distance from the second side of the contact block;

means for moving the armature between the minimum distance and the maximum distance from the second side of the contact block, wherein the means for moving the armature between the minimum distance and the maximum distance from the second side of the contact block, comprises:

a cam piece with a cam shape; and a means for providing resilient engagement of the cam piece and the armature;

a jumper pin block with a first side and a second side, wherein the first side of the jumper pin block faces the second side of the armature, wherein the jumper pin block comprises a plurality of pairs of male connectors with first end and second ends, wherein each pair of male connectors comprises a first male connector and a corresponding second male connector, wherein each second end of a first male connector is electrically connected to the second end of the corresponding second male connector, and wherein when the armature is at the maximum distance from the second side of the contact block, the second end of each male connector of the jumper pin block is electrically connected to a female connector of the armature and wherein when the armature is at the minimum distance from the second side of the contact block, the second end of each male connector of the jumper pin block is electrically disconnected from each female connector of the armature; and a housing disposed on the second side of the jumper pin block.

2. A switch, as claimed in claim 1, wherein the cam piece is between the armature and the jumper pin block.

3. A switch as claimed in claim 2, wherein the cam piece comprises a first side and a second side further having a cam shape on the first side.

4. A switch as claimed in claim 3, wherein the armature has a cam follower shape on the second side of the armature.

5. A switch as claimed in claim 4, wherein the means for resilient engagement is a spring.

6. A switch as claimed in claim 5, wherein the cam piece has a disc shaped body with an axis through the center of the disk.

7. A switch as claimed in claim 6, further comprising means for rotating the cam piece around the axis of the cam piece.

8. A switch device, comprising:

a first portion including a housing and a plurality of electrical connectors disposed in said housing:

a cam piece with a shaft located in said housing and connected to said shaft therein;

a second portion including a plurality of holes wherein electrical contacts for said electrical connectors are located in said holes;

an armature with a follower shape, wherein said armature comprises a first side and a second side with a plurality of electrical connector rods having first and second ends extend therefrom; and a spring means, disposed in said second portion, attached to said armature and follower shape to thereby provide a resilient contact between said cam piece and said follower shape.

9. A switch for opening and closing a first plurality of circuits, wherein each circuit has a first electrical lead and a corresponding second electrical lead, comprising:

a contact block with a first side and second side, comprising a plurality of pairs of female connectors, wherein each pair of female connectors has a first female connector and a corresponding second female connector and wherein each first electrical lead is electrically connected to a first female connector and each corresponding second electrical lead is electrically connected to a corresponding second female connector;

an armature, comprising a body with a first side and a second side and with a plurality of pairs of armature electrical connectors comprising a first electrical connector and a corresponding second electrical connector and a plurality of pairs rods comprising a first rod and a second rod extending from the first side of the armature wherein each rod has a first end and second end wherein the first end of a first rod is electrically connected to a first electrical connector in the armature and the second end of the first rod is inserted in a first female connector of the contact block and the first end of a second rod is electrically connected to a second electrical connector in the armature and the second end of the second rod is inserted in a second female connector of the contact block when the first side of the armature is placed within a minimum distance from the second side of the contact block, wherein the rods have a length such that the part of each rod will remain in a female connector of the contact block when the armature is moved between a minimum distance and a maximum distance from the second side of the contact block;

means for moving the armature between the minimum distance and the maximum distance from the second side of the contact block, wherein the means for moving the armature between the minimum distance and the maximum distance from the second side of the contact block, comprises:

a cam piece with a cam shape; and a means for providing resilient engagement of the cam piece and the armature;

a jumper pin block with a first side and a second side, wherein the first side of the jumper pin block faces the second side of the armature, wherein the jumper pin block comprises a plurality of pairs of electrical connectors with first end and second ends, wherein each pair of electrical connectors comprises a first electrical connector and a corresponding second electrical connector, wherein each second end of a first electrical connector is electrically connected to the second end of the corresponding second electrical connector, and wherein when the armature is at the maximum distance from the second side of the contact block, the second end of each first electrical connector of the jumper pin block is electrically connected to a first electrical connector of the armature and the second end of each second electrical connector of the jumper pin block is electrically connected to a second electrical connector of the armature and wherein when the armature is at the minimum distance from the second side of the contact block, the second end of each electrical connector of the jumper pin block is electrically disconnected from each electrical connector of the armature; and a housing disposed on the second side of the jumper pin block.

10. A switch, as claimed in claim 9, wherein the cam piece is between the armature and the jumper pin block.

11. A switch as claimed in claim 10, wherein the cam piece comprises a first side and a second side further having a cam shape on the first side.

12. A switch as claimed in claim 11, wherein the armature has a cam follower shape on the second side of the armature.

13. A switch as claimed in claim 12, wherein the cam piece has a disc shaped body with an axis through the center of the disk.

14. A switch as claimed in claim 13, further comprising means for rotating the cam piece around the axis of the cam piece.

* * * * *